US005343667A

United States Patent [19]

Peden

[11] Patent Number: 5,343,667

[45] Date of Patent: Sep. 6, 1994

[54] FORM BRACE

[76] Inventor: Frank G. Peden, 17382 Hwy. 126, Sisters, Oreg. 97759

[21] Appl. No.: 86,041

[22] Filed: Jul. 6, 1993

[51] Int. Cl.[5] ..... E04B 1/38

[52] U.S. Cl. ..... 52/699; 52/127.2; 249/219.1; 249/5

[58] Field of Search ..... 52/146–152, 52/699, 126, 169.1, 169.9, 426, 427, 127.7, 749, DIG. 1; 249/3, 4, 5, 219.1, 33

[56] References Cited

U.S. PATENT DOCUMENTS

| | | | |
|---|---|---|---|
| Re. 16,793 | 11/1927 | Smith . | |
| 396,624 | 1/1889 | Thomas . | |
| 826,124 | 7/1906 | Soseman . | |
| 1,126,190 | 1/1915 | Fuehrer . | |
| 1,924,724 | 8/1933 | Olney . | |
| 3,778,620 | 12/1973 | Burrows et al. | 249/219.1 |
| 3,785,606 | 1/1974 | Greer | 249/3 |
| 3,863,886 | 2/1975 | Carr . | |
| 4,068,427 | 1/1978 | Camardo . | |
| 4,070,833 | 1/1978 | Hancock . | |
| 4,075,913 | 2/1978 | Tye | 52/127.2 X |
| 4,678,156 | 7/1987 | Scalamandre et al. . | |
| 4,944,664 | 7/1990 | Allred | 249/33 X |

FOREIGN PATENT DOCUMENTS

| | | |
|---|---|---|
| 942732 | 2/1974 | Canada . |
| 2109444 | 9/1972 | Fed. Rep. of Germany . |
| 459173 | 10/1913 | France . |
| 1031305 | 3/1953 | France . |
| 529964 | 6/1955 | Italy . |
| 287536 | 2/1965 | Netherlands . |
| 364613 | 9/1962 | Switzerland . |

*Primary Examiner*—Carl D. Friedman
*Assistant Examiner*—Creighton Smith
*Attorney, Agent, or Firm*—Richard C. Litman

[57] ABSTRACT

A bracing system for a concrete form includes at least one spacer holding and spanning opposing sides of the form, and at least one inclined strut. The strut, at its upper end, attaches to the spacer and, at its lower end, engages the ground. The strut lower end has a spike and a foot plate for driving the spike into the ground by the user's weight. Preferably, two struts are employed, one on either side of the form. Both attach to the same spacer by dowel sockets and dowel pins. Each strut prevents the form from collapsing on its respective side. Each strut is independently adjustable as to length due to telescoping members having aligned holes, and is locked at a desired length by a spring loaded, captively retained pin. The bracing system is quickly and easily assembled by hand, and is retained in place by pins secured by clips.

8 Claims, 2 Drawing Sheets

FORM BRACE

BACKGROUND OF THE INVENTION

1. Field of the Invention

The present invention relates to a brace for holding a concrete form in place during pouring of fluent concrete.

2. Description of the Prior Art

Bracing assemblies for holding a wall or concrete form erect during construction, having feet engaging the surrounding ground surface for support, are were known. Examples include Dutch Pat. Document No. 287,536, dated Feb. 25, 1965; U.S. Pat. No. 4,068,427, issued to Gaspare Camardo on Jan. 17, 1978; and U.S. Pat. No. 4,070,833, issued to Loren Hancock on Jan. 31, 1978. The Dutch reference shows plural inclined braces located on opposing sides of a wall being supported, each engaging the ground and being attached to the wall at a common member.

Camardo '427 includes stakes which penetrate the ground, thus anchoring the foot of his brace. Hancock '833 shows telescoping brace members adjustable by insertion of a pin into aligned holes extending through the telescoping members.

Spacers for holding form boards parallel and spaced apart are seen in U.S. Pat. No. 1,924,724, issued to Harry B. Olney on Aug. 29, 1933, French Pat. No. 1,031,305, issued to Frederick Gilbert Mitchell on Mar. 18, 1953, and Swiss Pat. No. 364,613, issued to Samuel Barbey on Sep. 30, 1962. Olney '724 discloses a spacing holder having a head for adhering a brick veneer to the wall. If providing brick veneer is not desired, the head is detached from the holder.

None of the above inventions and patents, taken either singly or in combination, is seen to describe the instant invention as claimed.

SUMMARY OF THE INVENTION

The present invention is specifically directed to support for forms into which is poured fluent concrete. The bracing system includes a spacer holding two form boards apart and parallel, spanning the same, and two braces. The braces complete a structural triangle formed by a vertical form and a horizontal ground surface. Each brace attaches to the spacer on its respective side of the form, and resists collapse of the form on that side. At a lower end, the brace engages the ground by a spike. At its respective upper end, the brace attaches to the spacer, as by aligned sockets and dowel.

The brace comprises telescoping struts which are adjustably pinned at a desired length. A plurality of holes formed in one of the struts selectively provides fine length adjustment. Of course, the lower strut member can be made in different length dimensions, one strut being replaced by another of appropriate length, thus providing coarse length adjustment.

The spacer is lowered into place over the form boards, and may be screwed or otherwise secured to, the same.

The pin holding the telescoping struts in the desired position is spring biased into an operative position, and is captively retained to the outer strut.

The braces attach to the spacer by dowel and socket. The spacer has a socket on each respective side, and each brace has a cooperating socket. When aligned, a dowel is inserted through both a spacer socket and the associated brace socket. The dowel includes a manually removable clip.

In an alternative embodiment, the spacer is deleted, the socket and dowel arrangement attaching directly to the concrete form.

Thus, the entire bracing system is easily assembled and disassembled. It does not interengage the poured wall. Dowels and clips provide convenient attachment means for uniting the assembly, while resisting obstruction and damage by splattered concrete.

Accordingly, it is a principal object of the invention to provide a brace securing a vertical concrete form in solid, vertical orientation, resisting collapse in two directions.

It is another object of the invention to provide a bracing system which surroundingly engages the form, and which does not penetrate or attach to the poured wall.

It is a further object of the invention to provide a bracing system which is readily assembled and disassembled.

Still another object of the invention is to provide a bracing system which is adjustable as to the distance between attachment of a strut member to the top of the form and to the ground.

An additional object of the invention is to provide a bracing system which has a captively retained, spring biased member adjustably securing one telescoping strut member to its associated telescoping strut member.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
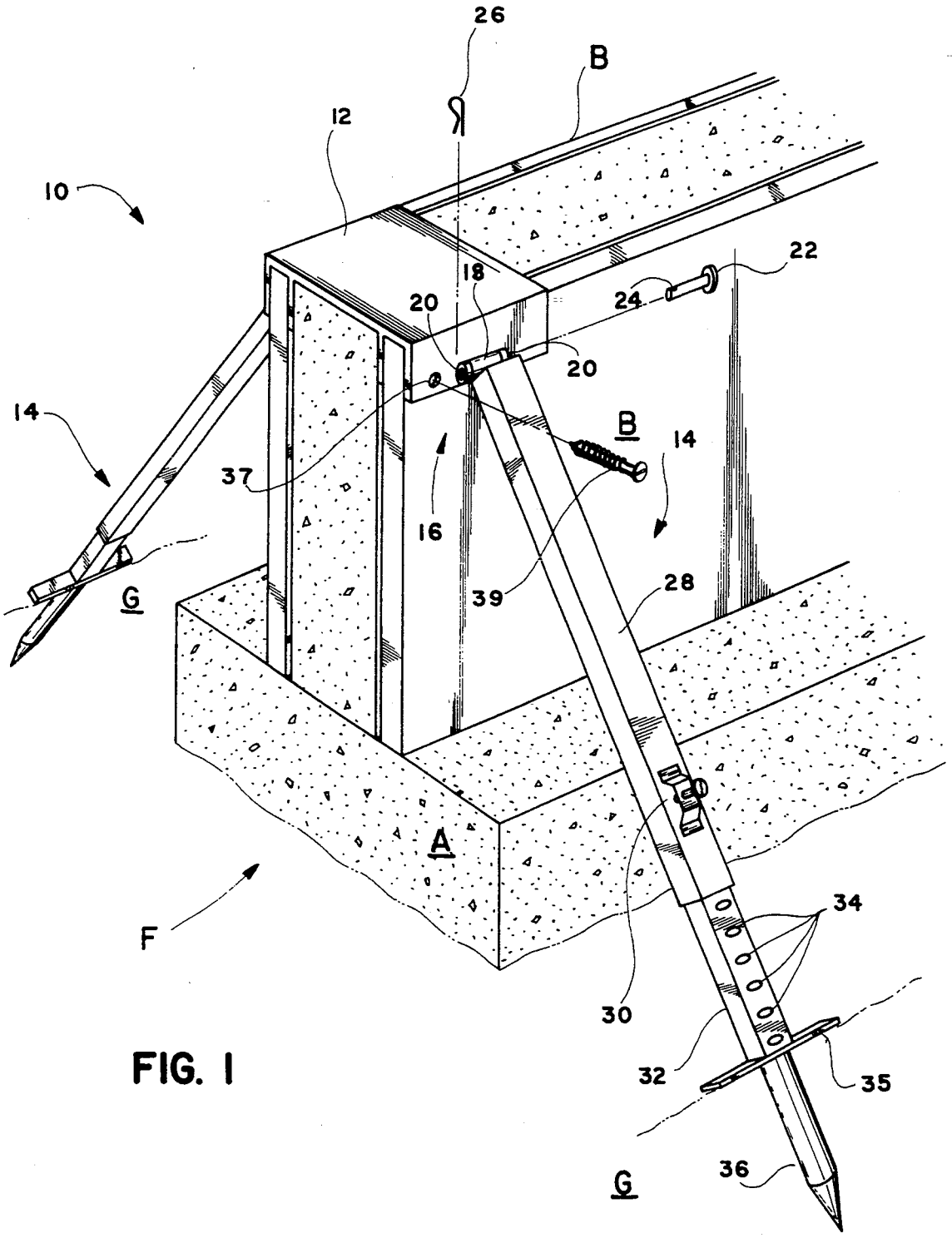
FIG. 1 is a perspective, environmental, partially exploded, partially cross sectional view of the invention.

The present invention comprises an assembly 10, best shown in FIG. 1, for securing to a form F for receiving poured concrete. Form F is typically erected upon a preformed foundation A, and is braced in vertical orientation by members secured within surrounding ground G. A spacer 12 is shown in place, lowered onto and spanning two form boards B. Form F is held against falling over in two directions by braces 14,14, each located on one side of form F. For brevity, the two supported sides of form F will be referred to as opposed sides, and the two associated directions will be referred to as opposing directions.

Each brace 14 attaches to spacer 12 at a hinge 16 formed by mutually aligned sockets 18,20 attached respectively to spacer 12 and to a brace 14. When aligned, sockets 18 and 20 are connected by insertion of a dowel 22. Dowel 22 has a radial through bore 24 for retaining a clip 26.

Each brace 14 has an upper, outer strut 28 having a hole 30 and an inner, lower strut 32. Lower strut 32 has a plurality of holes 34 for height adjustment, and a foot assembly for driving strut 32 into the ground G. The foot assembly includes a foot plate 35, onto which a user steps, and a spike 36. Application of body weight of a typical user is sufficient to drive spike 36 sufficiently into ground G to secure its associated brace 14 or 14 therein. Foot plate 35 also provides resistance against unintended penetration of its associated brace 14 or 14 into the ground, as could occur should a loaded form F start to lean.

A hole 37 is provided for enabling spacer 12 to be secured to concrete form member B, as by a fastener 39, which could be a nail or screw. This prevents spacer 12 from being unseated by an upwards force exerted by brace 14. If concrete form members A,B are made from metal, hole 37 is preferably threaded (not shown), and fastener 39 is preferably a bolt (not shown).

Figure 2:
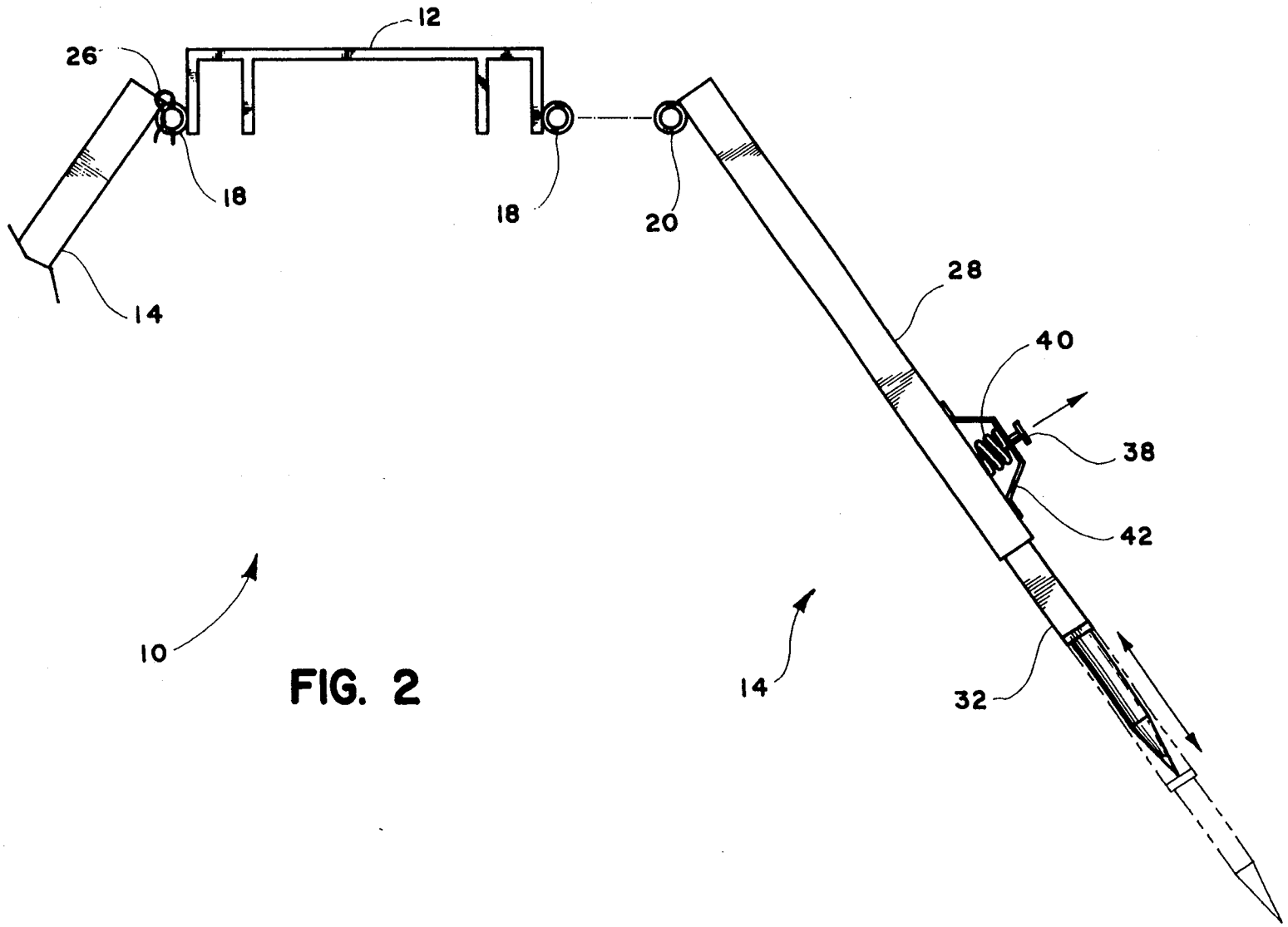
FIG. 2 is a partially exploded, side elevational detail view of the invention.

With reference to FIG. 2, brace 14 is adjusted to a desired height by withdrawing a pin 38 from upper strut 28 sufficiently to free inner strut 32. Inner strut 32 is positioned as desired, and pin 38 is released. A spring 40, captively retained by a covering member 42 so as to bias pin 38 to penetrate struts 28 and 32, then automatically locks, thus telescoping struts 28 and 32 together. Covering member 42 also shields spring 40 and holes 30 and 34 from contamination by splattered concrete. Where desired, covering member 42 could be formed to enclose spring 40 completely, to provide further protection from contamination.

Bracing assembly 10 preferably comprises two braces 14,14 attached to spacer 12, although only one brace 14 could be employed where suitable. To this end, spacer 12 has two sockets 18, one on each of the opposed sides. Thus, a free standing form F is braced against collapse to either possible side.

It is to be understood that the present invention is not limited to the embodiments described above, but encompasses any and all embodiments within the scope of the following claims.

I claim:

1. A bracing system for concrete forms having opposed vertical form boards, said bracing system including:

at least one inclined brace having an upper and a lower end and comprising telescoping inner and outer struts, one of said inner and outer struts having means defining at least one first hole, and the other of said inner and outer struts having means defining a plurality of second holes, said first and second holes selectively aligning, said inclined brace also including a pin corresponding in cross sectional configuration to said first and second holes, whereby said pin is inserted through one said first hole and one said second hole, said inclined brace being adjusted as to length thereby, one of said inner and outer struts engaging the ground and including a foot having a foot plate and a spike penetrating the ground, whereby said foot anchors said inclined brace in the ground, the other of said inner and outer struts including strut attachment means secured thereto at said upper end and anchoring at the concrete form, and at least one spacer having opposing sides and comprising two pairs of parallel walls for surroundingly engaging, respectively, opposed form boards, and two spacer attachment means cooperating with and attaching to said strut attachment means, whereby said spacer holds two form boards in parallel, spaced apart relation and secures one said upper end of one said inclined brace on one side of said spacer and secures another said upper end of another said inclined brace to an opposed side of said spacer, while said one inclined brace is also secured at said lower end by penetrating the ground, whereby said bracing system, when assembled, is braced against collapse in opposing directions, said strut attachment means comprising a first dowel socket, and said spacer attachment means comprising a second dowel socket, said first and second dowel sockets aligning with one another when said strut and said spacer are in operative positions with respect to an assembled concrete form, said strut attachment means further comprising a dowel which is placed in and unites said strut attachment means and said spacer attachment means, said dowel having means defining a radial bore therein, there further being a clip which is manually inserted into and withdrawn withdrawn from said bore, and said outer strut further having means captively retaining said pin and a spring biasing said pin into an operative position.

2. The bracing system according to claim 1, there further being a plurality of said other of said inner and outer struts having means defining a plurality of second holes, each one of said other of said inner and outer struts having a length dimension varying from another said other of said inner and outer struts.

3. The bracing system according to claim 1, said inclined brace further comprising a member covering said spring, whereby said spring is protected against contamination.

4. A bracing system for concrete forms having two opposed vertical form boards, said bracing system including:

at least one inclined brace having an upper and a lower end and comprising telescoping inner and outer struts, one of said inner and outer struts having means defining at least one first hole, and the other of said inner and outer struts having means defining a plurality of second holes, said first and second holes selectively aligning, said inclined brace also including a pin corresponding in cross sectional configuration to said first and second holes, whereby said pin is inserted through one said first hole and one said second hole, said inclined brace being adjusted as to length thereby, one of said inner and outer struts engaging the ground and including a foot having a foot plate and a spike penetrating the ground, whereby said foot anchors said inclined brace in the ground, the other of said inner and outer struts including strut attachment means secured thereto at said upper end and anchoring at the concrete form, at least one attachment means cooperating with and attaching to said strut attachment means, and attaching to a concrete form, whereby said at least one inclined brace is removably attached to the concrete form, thus constraining the concrete form against collapse, and at least one spacer comprising two pairs of parallel walls for surroundingly engaging, respectively, opposed form boards, said at least one attachment means cooperating with and attaching to said strut attachment means, whereby said spacer holds two form boards in parallel, spaced apart relation and secures said upper end of one said inclined brace, while said one inclined brace is also secured at said lower end by penetrating the ground.

5. The bracing system according to claim 4, there further being a plurality of said other of said inner and outer struts having means defining a plurality of second holes, each one of said other of said inner and outer struts having a length dimension varying from another said other of said inner and outer struts.

6. The bracing system according to claim 4, said strut means comprising a first dowel socket, and said attachment means comprising a second dowel socket, said first and second dowel sockets aligning with one another when said strut is in operative positions with respect to an assembled concrete form, said strut attachment means further comprising a dowel which is placed in and unites said strut attachment means and said attachment means, said dowel having means defining a radial bore therein, there further being a clip which is manually inserted into and withdrawn withdrawn from said bore.

7. The bracing system according to claim 4, said outer strut further having means captively retaining said pin and a spring biasing said pin into an operative position.

8. The bracing system according to claim 4, there being two spacer attachment means located on opposing sides of the concrete form, and there being two of said inclined brakes, whereby said bracing system, when assembled, is braced against collapse in opposing directions.

* * * * *